US007661337B2

(12) United States Patent
Chen

(10) Patent No.: US 7,661,337 B2
(45) Date of Patent: Feb. 16, 2010

(54) FIXING STRUCTURE OF DIRECTION SWITCH BUTTON FOR REVERSIBLE WRENCH

(75) Inventor: Terence Chen, Chang-Hwa (TW)

(73) Assignee: Infar Industrial Co., Ltd., Chang-Hwa (TW)

( * ) Notice: Subject to any disclaimer, the term of this patent is extended or adjusted under 35 U.S.C. 154(b) by 59 days.

(21) Appl. No.: 11/772,482

(22) Filed: Jul. 2, 2007

(65) Prior Publication Data

US 2009/0007731 A1 Jan. 8, 2009

(51) Int. Cl.
*B25B 13/46* (2006.01)

(52) U.S. Cl. ..... 81/62; 81/63.1; 81/63

(58) Field of Classification Search ..... 81/60–63.2
See application file for complete search history.

(56) References Cited

U.S. PATENT DOCUMENTS 1,078,059 A * 11/1913 Mossburg ..... 81/63
2004/0089111 A1* 5/2004 Hsien ..... 81/63.2
2004/0237727 A1* 12/2004 Huang ..... 81/62
2005/0011315 A1* 1/2005 Chen ..... 81/63.1
2005/0092135 A1* 5/2005 Chen ..... 81/63.1

* cited by examiner

*Primary Examiner*—Hadi Shakeri
(74) *Attorney, Agent, or Firm*—Rosenberg, Klein & Lee

(57) ABSTRACT

A fixing structure of direction switch buttons for a reversible wrench, in which the wrench is equipped with two direction switch buttons on a driving portion of the wrench. The wrench includes button-restricting portions and location-restricting portions relative to the driving portion. The two direction switch buttons can be inserted and arranged inside the driving portion. Moreover, a button-fixing device is provided between the two direction switch buttons, the button-fixing device includes an actuating member and a restoring member. The two ends of the actuating member are wedged into the two direction switch buttons respectively so that the two direction switch buttons are driven simultaneously. The actuating member is able to move elastically between the two direction switch buttons by the restoring member so as to connect the two direction switch buttons elastically.

6 Claims, 9 Drawing Sheets

FIXING STRUCTURE OF DIRECTION SWITCH BUTTON FOR REVERSIBLE WRENCH

FIELD OF THE INVENTION

The present invention generally relates to a fixing structure of direction switch buttons for a reversible wrench, and more particularly to a wrench with two direction switch buttons that are equipped with a quick positioning structure in-between, with cooperation of the two direction switch buttons and the inserting structure on the wrench, the two direction switch buttons can be positioned and integrated into one piece while they insert into the wrench.

BACKGROUND OF THE INVENTION

Conventional wrenches are provided with a direction switch including two direction control members that are actuated simultaneously. There are many prior arts approved, such as U.S. Pat. No. 6,918,477, in which both sides of a driving portion of a wrench are each equipped with a direction control member respectively, and a coupling means is provided between the direction control members to allow simultaneous actuation thereof. The structure of the coupling means has many embodiments, in which the two direction control members are equipped with structures that are operatively connected with each other, through a penetrating bore to connect into a structure of simultaneous actuation on the wrench. Such structures have shortcomings, which are:

1. The structured of the direction control members are too complicated to be formed easily: because the direction control members must have the structures matched with each other, therefore, the structures of the direction control members are too complicated, which are not only hard to be formed but also high cost of manufacture, it is necessary to be improved.

2. Limited stability of connection: because the direction control member s are formed into a structure of connection with each other, the strength of the connection is extremely limited, there is the shortcoming of coming off after an impact, therefore, the whole direction control structure is unable to be operated efficiently, which will affect the lifetime of the whole structure.

This case has another embodiments, in which after the connection of the two direction control members, which are screwed together by a screw. However the structure of the screw connection needs to dispose a through hole and an inner-threaded hole on the direction control members respectively, so that the screw can pass through one direction control member and fasten the other direction control member together, so as to connect the two direction control members into a structure of simultaneous actuation. Such structure still has shortcomings, which are:

1. The structure and assembly are still too complicated: after the two direction control members are connected together, which need to be screwed, that has not only the forementioned shortcomings but also the complication of assembly, therefore, which consumes unnecessary cost of labor and assembly structure, it needs to be improved.

2. The screw connection is unstable: because the place of using the wrench might have not only high frequency of shaking but also greasiness, the screw is easy to loosen due to the shaking, and furthermore the location of the screw is easy to cause unnecessary contamination due to the greasiness, so that while the direction control members are damaged, which are hard to exchange efficiently and instantly, it is inconvenient to use.

SUMMARY OF THE INVENTION

Being aware of the shortcomings mentioned above, to have a wrench with two direction switch buttons that is more fast and convenient to fix the direction switch buttons, and more stable on the structure of connection to achieve the best state of use, the inventor develops a fixing structure of direction switch buttons that is fulfilled the requirements mentioned above.

The main objective of the present invention is to provide a fixing structure of direction switch buttons for a reversible wrench. In which an elastic button-fixing device is provided between the two direction switch buttons, with cooperation of button-restricting portions on the relative locations of the wrench and location-restricting portions of the two direction switch buttons, so that the two direction switch buttons are positioned on the relative locations of the wrench by the method of insertion. In addition with the elastic button-fixing device, the objective of fast positioning of the direction switch buttons is achieved.

The other objective of the present invention is to provide a fixing structure of direction switch buttons for a reversible wrench. In which an elastic button-fixing device is provided between the two direction switch buttons, the button-fixing device comprises an actuating member and a restoring member. The two ends of the actuating member are wedged into the two direction switch buttons respectively. The actuating member possesses elasticity by means of the restoring member, so that the two direction switch buttons can be inserted into the relative locations of the wrench in order and actuated together by the actuating member. The objectives of simplification of the whole structure and fast assembly are achieved.

The present invention will become more obvious from the following description when taken in connection with the accompanying drawings that show, for purposes of illustration only, a preferred embodiment in accordance with the present invention.

DETAILED DESCRIPTION OF THE PREFERRED EMBODIMENT

Figure 1:
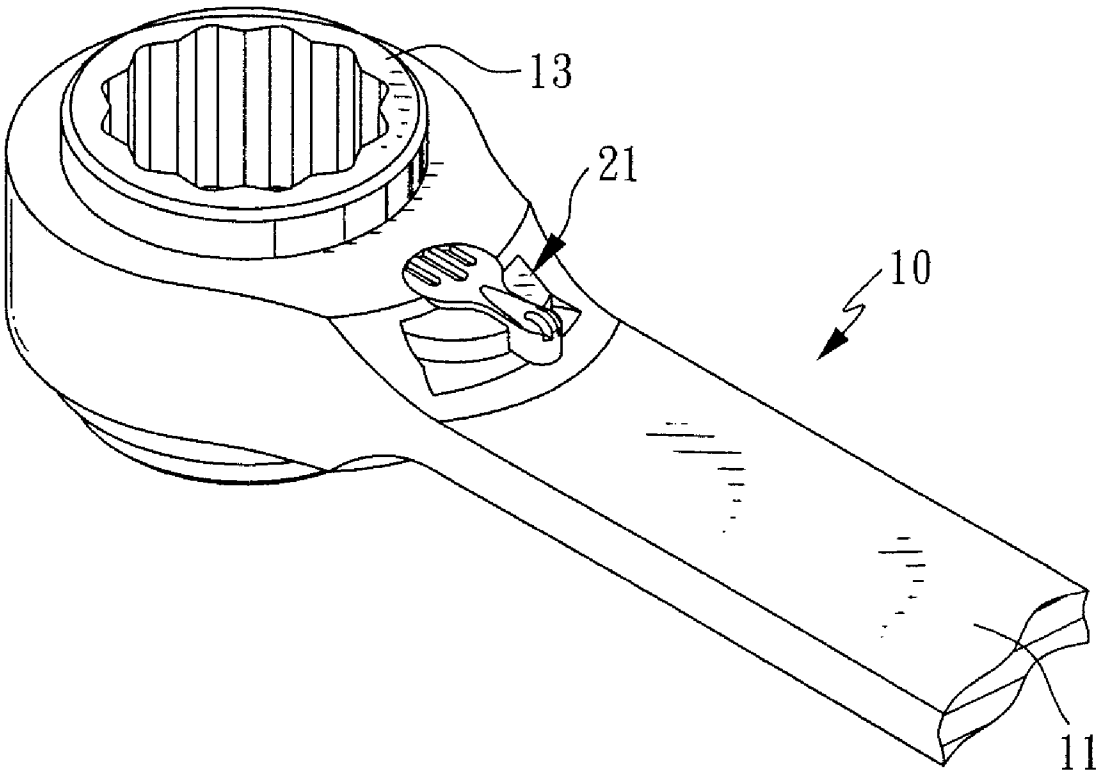
FIG. 1 is a perspective view of the appearance of the present invention.
Figure 2:
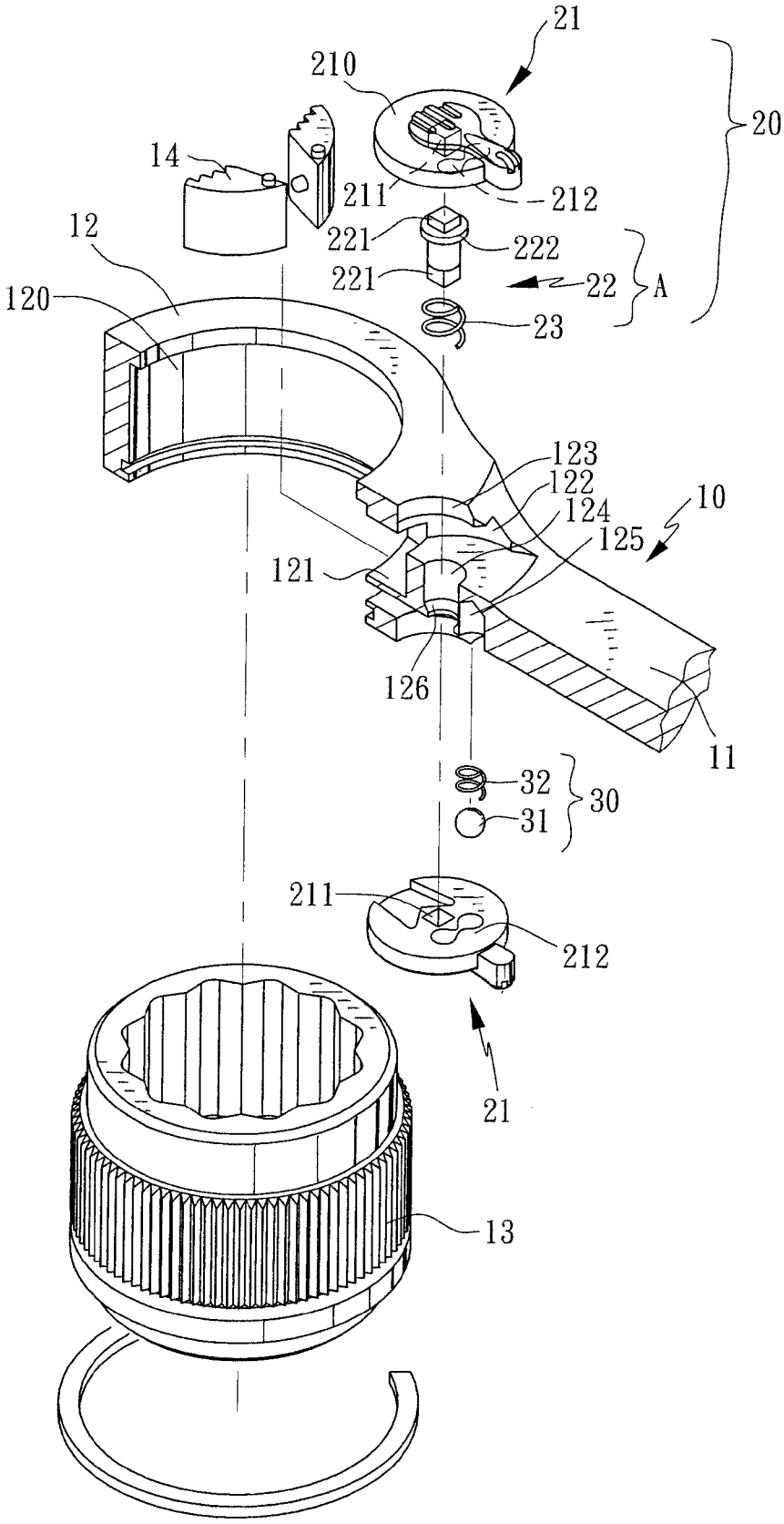
FIG. 2 is an exploded view of the present invention.
Figure 3:
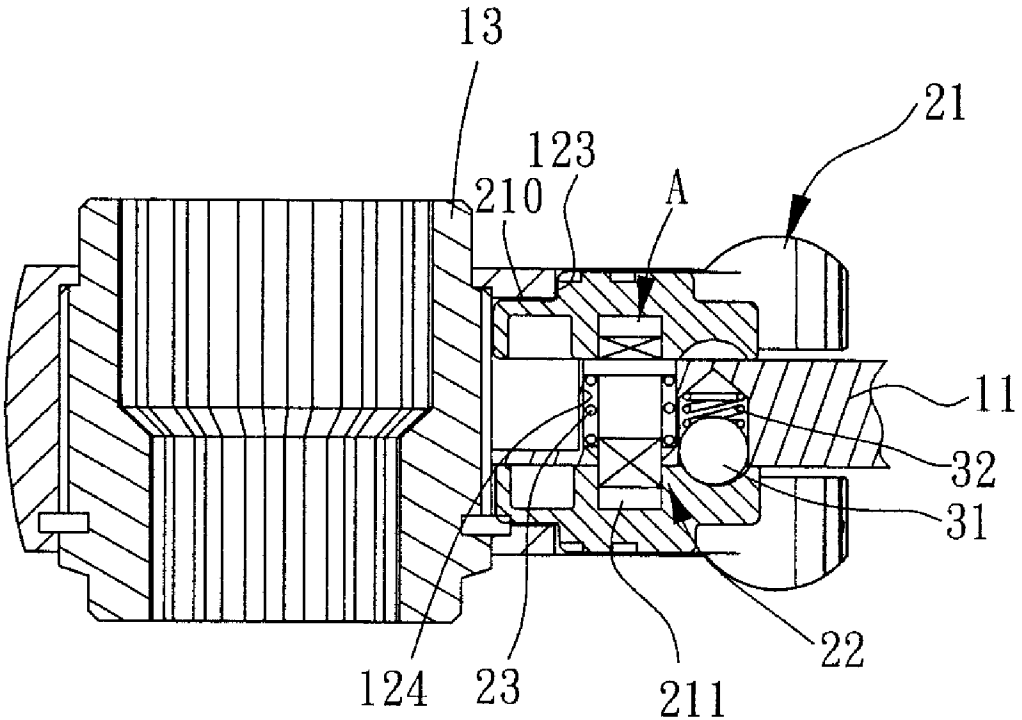
FIG. 3 is a cross-sectional view of the assembly of the present invention.

Referring to FIGS. 1 to 3, a wrench 10 of the present invention consists of a handle 11 and a driving portion 12 with an opening on the center that is extended from the handle. The driving portion 12 is provided with an opening of accommodating portion 120 on the center thereof for accommodating a driving member 13 with ratchet on the outside. A receiving portion 121 is provided on one side of the accommodating portion 120. The driving member 13 has a urging pawl 14 that is accommodated inside the receiving portion 121. The urging pawl 14 is driven by direction switch buttons 21 of the direction switch device 20. The primary feature of the present invention is the arrangement of a button-fixing device A provided between the direction switch buttons 21 and the improvement of the structure of the relative location between the direction switch buttons 21 and the wrench 10.

The wrench 10 is disposed with button-restricting portions 122 with given thicknesses relative to the direction switch buttons 21. The given thicknesses of the button-restricting portions 122 are formed with button-accommodating portions 123 penetrated horizontally into the receiving portion 121 for the direction switch buttons 21 to insert horizontally along the surfaces of the handle 11. With the cooperation of the button-fixing device A of the direction switch device 20, the two direction switch buttons 21 can be positioned firmly and quickly.

The driving portion 12 of the wrench 10 is disposed with a through hole of containing portion 124 relative to the centers of the direction switch buttons 21 for accommodating the button-fixing device A of the direction switch device 20. The driving portion 12 of the wrench 10 is also disposed with at least one shallow hole of positioning portion 125 and one positioning device 30 for fixing the direction controlled by the direction switch buttons 21. The containing portion 124 can be equipped with a smaller diameter of stopping portion 126 on one end thereof for the button-fixing device A to push against.

Mainly, the direction switch device 20 has two opposite direction switch buttons 21, and the button-fixing device A is provided between the two direction switch buttons 21. The button-fixing device A is arranged inside the containing portion 124 of the driving portion 12 of the wrench 10.

The two direction switch buttons 21 are equipped with tails for an operator to switch with fingers and discs of location-restricting portions 210 that can insert into the button-accommodating portions 123 horizontally. Parts of the location-restricting potions 210 reach to the receiving portion 121 to control the urging pawl 14, which are conventional structures and not the features of the present invention, so that further description is superfluous.

The location-restricting portions 210 of the two direction control buttons 21 each has a polygonal button-fixing portion 211 on the center of the opposite side for the button-fixing device A to be wedged into and to drive together with, and a semicircular fixing portion 212 next to the button-fixing portion 211 for the positioning device 30 to be wedged into elastically and be positioned.

The forementioned button-fixing device A includes mainly an actuating member 22 and a restoring member 23 cooperated with the actuating member 22 to be wedged into the two direction switch buttons 21 elastically. The actuating member 22 is formed as a cylinder and two ends of the actuating member 22 are equipped with polyhedrons of button-actuating portions 220 relative to the button-fixing portions 211. The button-actuating portions 220 can be wedged into the button-fixing portions 211 to drive the two direction switch buttons 21. The cylinder between two button-actuating portions 220 of the actuating member 22 is formed with a disc of urging portion 222 with large diameter near one of the button-actuating portions 220 for one end of the spiral restoring member 23 to push against with. The other end of the restoring member 23 pushes against the stopping portion 126 to provide the actuating member 22 the strength of wedging elastically with the direction switch button 21.

Figure 4:
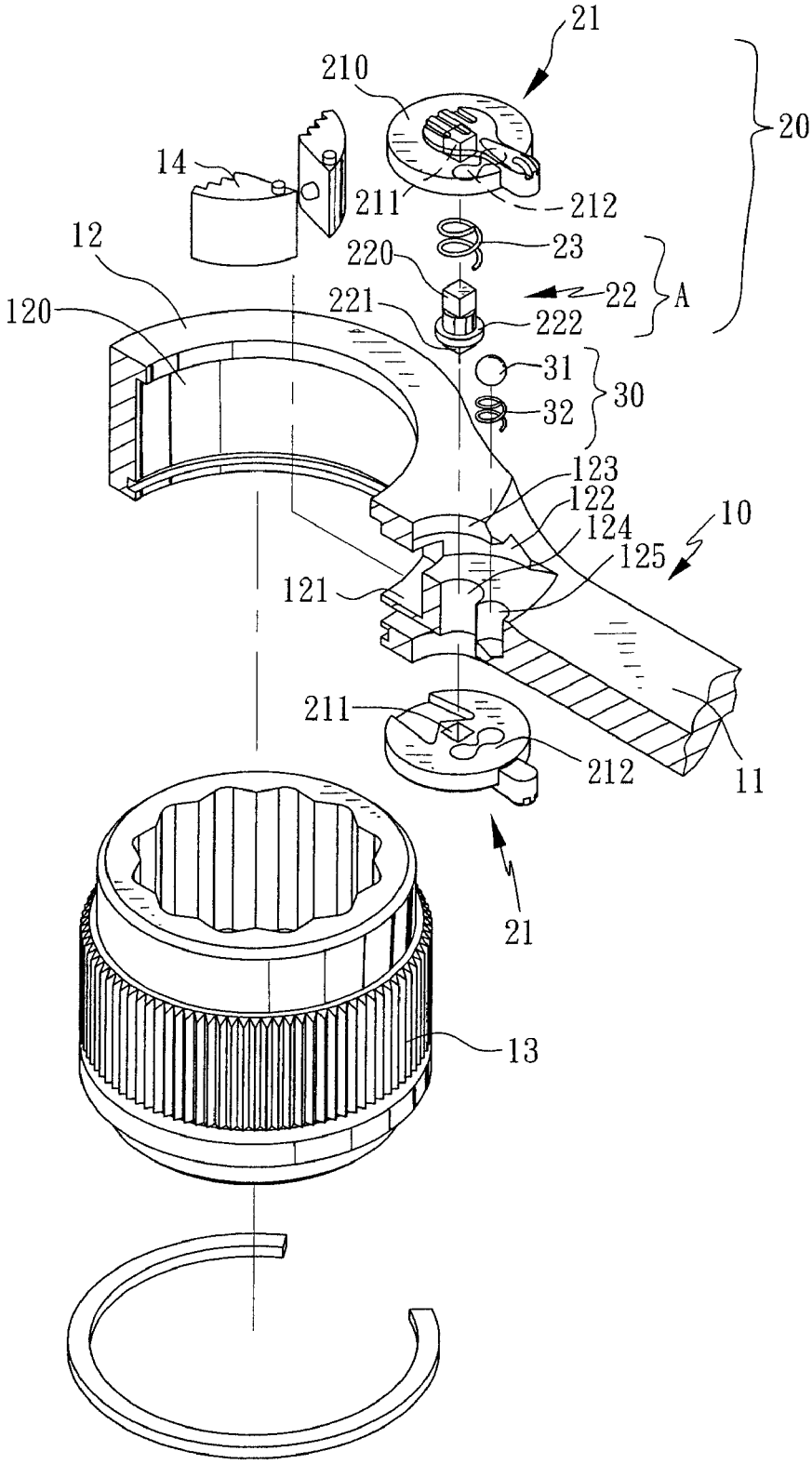
FIG. 4 is an exploded view of the containing portion of the wrench of the present invention being an equal diameter of through hole.
Figure 5:
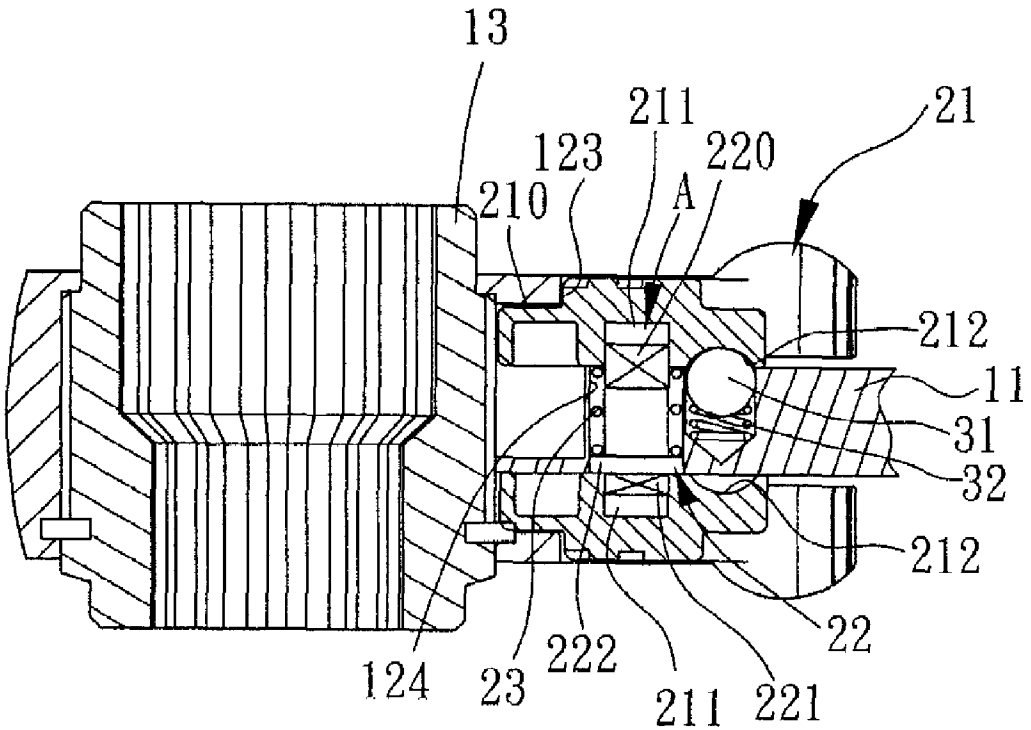
FIG. 5 is a cross-sectional view of the assembly of the present invention in accordance with FIG. 4.

The containing portion 124 of the wrench 10 can be as shown in FIGS. 4 and 5, which is in the form of a through hole with an equal diameter. Therefore, the button-fixing device A can be installed from either direction. One end of the restoring member 23 of the button-fixing device A pushes against the urging portion 222 of the actuating member 22, so that the button-actuating portion 220 near the urging portion 222 can be wedged elastically into the button-fixing portion 211 of the direction switch button 21. The other end of the restoring member 23 pushes against the other direction switch button 21 so as to provide the actuating member 22 an elastic prestressing force.

Figure 6:
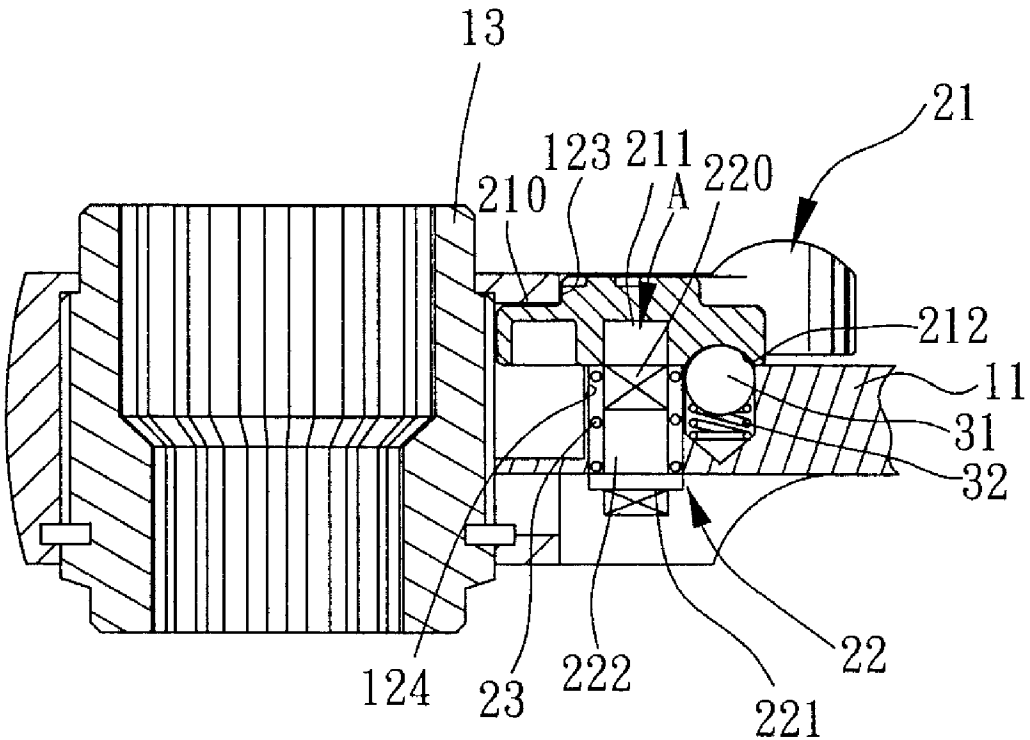
FIG. 6 is a cross-sectional view of the assembly of the first direction switch button of the present invention.
Figure 7:
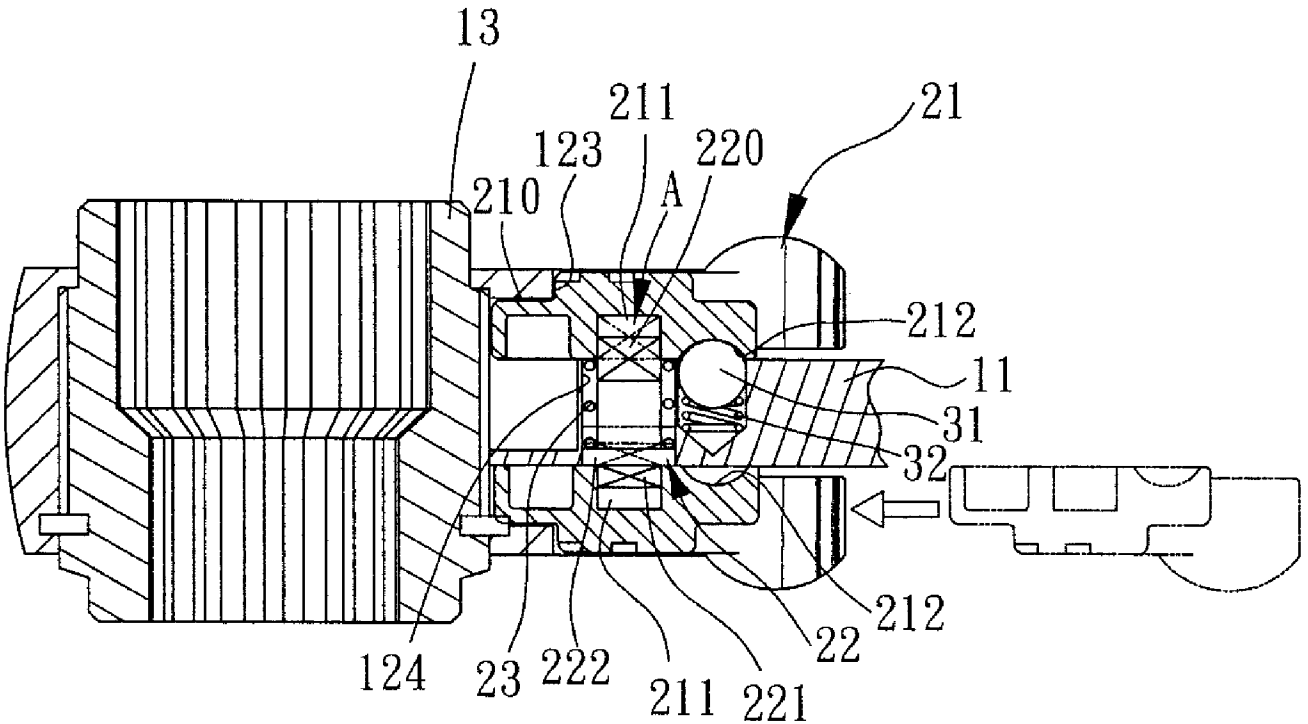
FIG. 7 is a cross-sectional view of the assembly of the second direction switch button of the present invention.

The length of the actuating member 22 is slightly shorter than the length of two button-fixing portions 211 plus the containing portion 124, therefore, to install the direction switch buttons 21, first to put the actuating member 22 and the restoring member 23 of the button-fixing device A into the containing portion 124. Then, as shown in FIG. 6, to press the end of the button-actuating portion 220 of the actuating member 22 inside the containing portion 124, the location-restricting portion 210 of the first direction switch button 21 can be inserted horizontally via the button-accommodating 123, the actuating member 22 has a prestressing force due to the other end of the actuating member 22 being pushed against by the restoring member 23. While the second direction switch button 21 is inserted via another button-accommodating portion 123 as shown in FIG. 7, pressing the button-actuating portion 220 of the actuating member 22 into the containing portion 124, the restoring member 23 is pressed simultaneously by the urging portion 222. After the second direction switch button 21 is inserted thereinto, the button-fixing portion 211 on the center of the second direction switch button 21 aims at the button-actuating portion 220 of the actuating member 22. The button-actuating portion 220 of the actuating member 22 is wedged into the relative button-fixing portion 211 by the elastic push of the restoring member 23. Therefore, the second direction switch button 21 is fixed and driven together with the actuating member 22 exactly. The button-actuating portion 220 on the other end of the actuating member 22 still has a portion of structure wedged inside the button-fixing portion 211 of the first direction switch button 21, so as to drive the first direction switch button 21 simultaneously.

The forementioned positioning device 30 comprises a ball of positioning member 31 and a spiral spring of urging member 32 relative to the positioning portion 125, so that the positioning member 31 is able to be wedged into the fixing portion 212 of the direction switch button 21 elastically, so as to fix the direction switch button 21 at the direction that the operator chose.

Via the forementioned structures of the button-fixing device A and the related structures of the wrench 10, the direction switch device 20 can reach the functions and purposes exactly as follows:

1. Structure simplified: via the button-fixing device A consisting of the actuating member 22 and the restoring member 23, and the arrangement of the button-accommodating portion 123 and button-restricting portion 122, the direction switch buttons 21 just need to be installed in order, the structures are very simplified and the cost is extremely limited, which is a low cost and high efficiency structure.
2. Positioning exactly: via the button-fixing device A wedging elastically into the two direction switch buttons 21, which is fast and convenient to install, position and drive together;

after the installation of the structure, the two direction switch buttons 21 are unable to withdraw so that the structure is extremely stable and precise, the lifetime is extremely long, and there is no shortcoming of coming off, which is more superior than the conventional structure.

Figure 8:
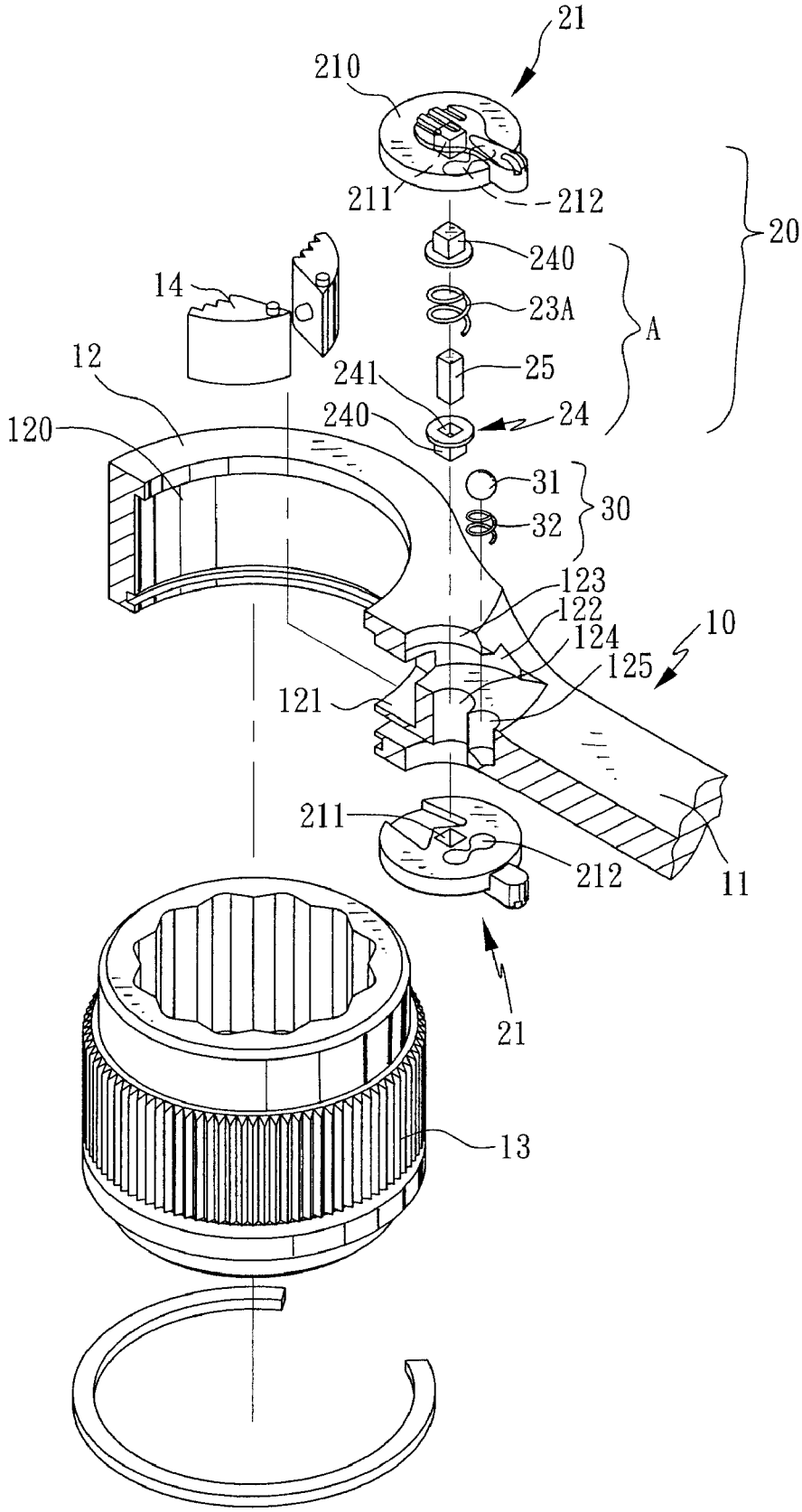
FIG. 8 is an exploded view of the second embodiment of the present invention.

The button-fixing device A of the present invention has different embodiments, as shown in FIG. 8, the button-fixing device A mainly comprises two actuating members 24 relative to the direction switch buttons 21, an interlocking member 25 arranged between the two actuating members 24 and a restoring member 23A. Wherein, the two actuating members 24 are equipped with same shape of button-actuating portions 240 relative to the button-fixing portions 211 of the direction switch buttons 21, and square cavity of driving portions 241 relative to the ends of the interlocking member 25 for the ends of square bar of interlocking member 25 to insert and drive together. The two ends of the restoring member 23A are pushed against the two actuating members 24 respectively, so that the two actuating members 24 have the strength of wedging elastically with the two direction switch buttons 21, which also can reach each function mentioned above.

Figure 9:
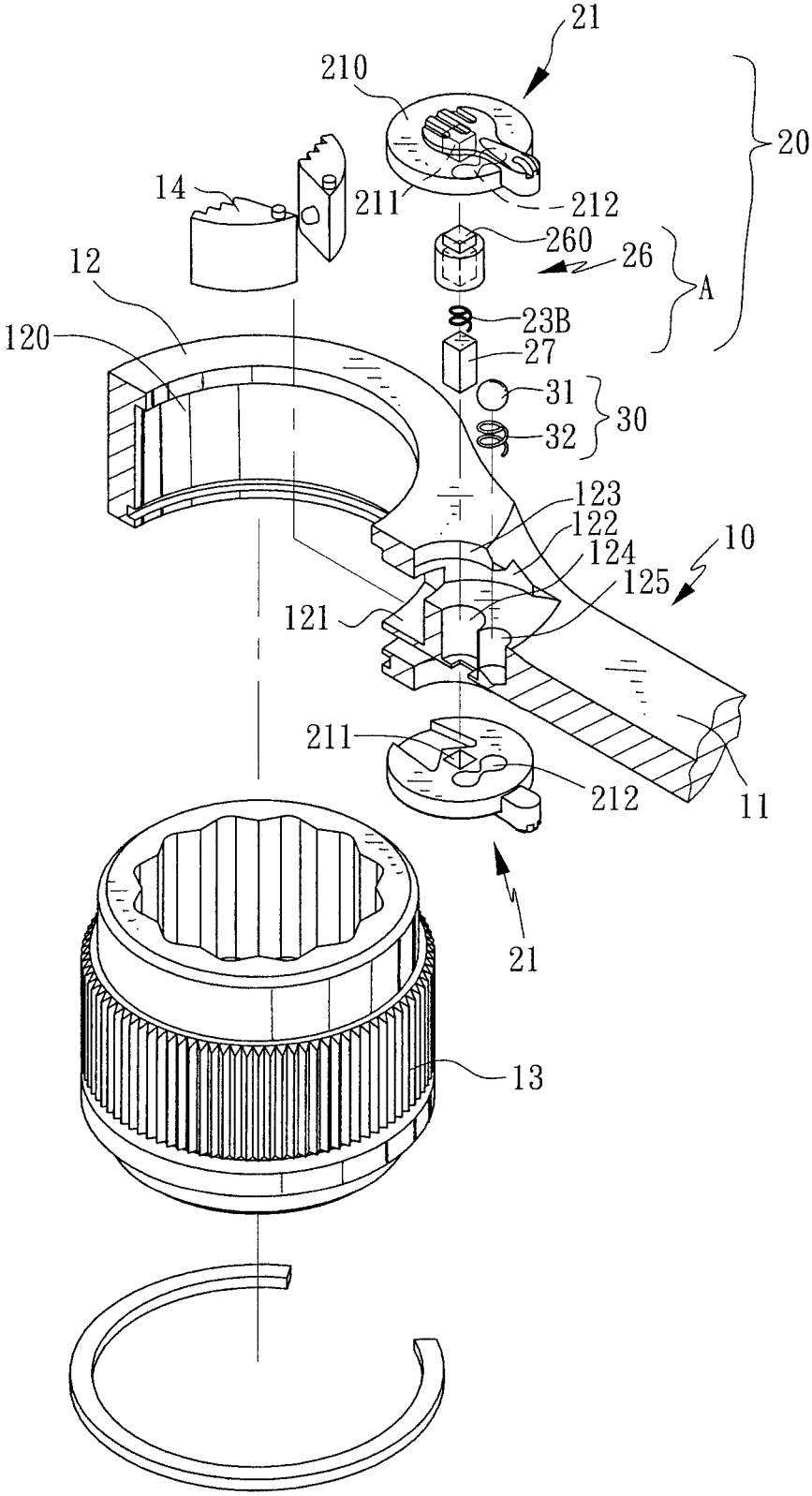
FIG. 9 is an exploded view of the third embodiment of the present invention.

The present invention can also be the structure as shown in FIG. 9, the button-fixing device A mainly comprises a primary actuating member 26 and a secondary actuating member 27 mounted within the relative end of the primary actuating member 26. A restoring member 23B is disposed between the primary and secondary actuating members 26 and 27, so that the primary and secondary actuating members 26 and 27 have the strength of wedging with the two direction switch buttons 21. Wherein, the primary actuating member 26 is equipped with a polyhedron of button-actuating portion 260 relative to the direction switch button 21, and the other end of the secondary actuating member 27 is wedged directly into the other direction switch button 21 so as to attain the objective of wedging elastically into the two direction switch buttons 21.

While we have shown and described the embodiment in accordance with the present invention, it should be clear to those skilled in the art that further embodiments may be made without departing from the scope of the present invention.

What is claimed is:

1. A reversible wrench comprising:

a handle, a driving portion extending from an end of the handle, a driving member accommodated in an accommodating portion of the driving portion, at least one urging pawl, a receiving portion equipped with a side of the accommodating portion and accommodating the at least one urging pawl, two button-restricting portions formed and connected with the receiving portion and two button-accommodating portions formed at the handle between the button-restricting portions and the handle, with the two button-accommodating portions opposed to each other, and with the button-accommodating portions and the receiving portion of the wrench being intercommunicated;

a positioning device; and two direction switch devices, each disposed between the handle and the driving portion and including a direction switch button including a button-fixing portion adapted to drive the urging pawl, and a button-fixing device including an actuating member having two button-actuating portions wedged in the button-fixing portion of the two direction switch buttons respectively, with each direction switch button having a fixing portion and the positioning device engaged in one fixing portion, with the positioning device received in a positioning portion of the wrench, and with the button-fixing device disposed between the positioning device and the receiving portion;

wherein the button-fixing device further includes a restoring member adapted to be pushed by the actuating member for providing an elastic prestressing force;

wherein the actuating member and the restoring member are received in a containing portion of the wrench, with the containing portion including a first diametrical cross sectional area, and with the containing portion including a stropping portion with a second diametrical cross sectional area reduced from the first diametrical cross sectional area;

wherein the actuating member includes a third diametrical cross sectional area and an urging portion extended thereon, with the urging portion including a fourth diametrical cross sectional area increased from the third diametrical cross sectional area, with the restoring member of the button-fixing device having one end pushing against the urging portion of the actuating member and another end retained in the stopping portion, so that the button-actuating portion is adapted to be moved elastically to wedge into the button-fixing portion of the direction switch button.

2. The reversible wrench as claimed in claim 1, with the actuating member cooperated with the restoring member for wedging into the direction switch buttons elastically, with the actuating member in form of a cylinder.

3. The reversible wrench as claimed in claim 2, wherein the button-fixing portion of the related direction switch button is in form of a polygon.

4. The reversible wrench as claimed in claim 1, wherein each direction switch button has a location-restricting portion inserted into the related button-accommodating portion, and with the location-restricting portion partially received in the receiving portion for controlling the urging pawl.

5. The reversible wrench as claimed in claim 1, wherein each of the direction switch buttons has a location-restricting portion, with the button-fixing portion of the related direction switch disposed on one side of the location-restricting portion for receiving the button-fixing device and wherein the direction switch buttons are driven together.

6. The reversible wrench as claimed in claim 1, wherein each direction switch button has a location-restricting portion and the button-fixing portion of the related direction switch button is in form of a polygon and is provided on the location-restricting portion of the related direction switch button.

* * * * *